US007024881B2

(12) United States Patent
Jung

(10) Patent No.: US 7,024,881 B2
(45) Date of Patent: Apr. 11, 2006

(54) REFRIGERATOR WITH DOOR HANDLE

(75) Inventor: Sang Gyu Jung, Gwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 42 days.

(21) Appl. No.: 10/814,805

(22) Filed: Apr. 1, 2004

(65) Prior Publication Data

US 2005/0217309 A1 Oct. 6, 2005

(51) Int. Cl.
*F25D 11/02* (2006.01)

(52) U.S. Cl. ..... 62/441; 62/298; 62/515

(58) Field of Classification Search ..... 62/199, 62/298, 441, 448, 513, 515
See application file for complete search history.

(56) References Cited

U.S. PATENT DOCUMENTS 4,340,404 A * 7/1982 Oonishi et al. ..... 62/198
4,862,707 A * 9/1989 Hill et al. ..... 62/431
5,819,547 A * 10/1998 Oh ..... 62/188
6,185,948 B1 * 2/2001 Niki et al. ..... 62/199

FOREIGN PATENT DOCUMENTS

KR 1994-2225 3/1994

* cited by examiner

*Primary Examiner*—Melvin Jones
(74) *Attorney, Agent, or Firm*—Staas & Halsey LLP

(57) ABSTRACT

The present invention relates to a refrigerator, which allows more easy inspection to detect leakage of refrigerant. The refrigerator comprises a body defined with a refrigerating compartment and a freezing compartment therein, a machinery chamber defined at an upper portion of the body and adapted to receive components of a refrigerant cycle therein, first and second evaporators for cooling the refrigerating and freezing compartments, respectively, a first refrigerant pipe extending from the first evaporator, a second refrigerant pipe extending from the second evaporator, an assistant capillary pipe connected between the first and second refrigerant pipes for cooling the refrigerating and freezing compartments to different temperatures, a capillary pipe container provided in the machinery chamber for receiving the assistant capillary pipe therein, and an inspection hole provided at one side of the capillary pipe container for allowing a detection device for detecting leakage of refrigerant to be inserted into the capillary pipe container.

4 Claims, 3 Drawing Sheets

REFRIGERATOR WITH DOOR HANDLE

CROSS-REFERENCE TO RELATED APPLICATION

This application claims the benefit of Korean Patent Application No. 2004-21500, filed on Mar. 30, 2004 in the Korean Intellectual Property Office, the disclosure of which is incorporated herein by reference.

BACKGROUND OF THE INVENTION

1. Field of the Invention

The present invention relates to a refrigerator, and, more particularly, to a refrigerator, which allows more easy inspection to detect leakage of refrigerant.

2. Description of the Related Art

Generally, a refrigerator is an apparatus for generating cold air, using a refrigerant cycle, to maintain freshness of food for a long time.

The refrigerator is structured such that a refrigerating compartment for storing the food in a refrigerated state and a freezing compartment for storing the food in a frozen state are partitioned in a body defining an appearance of the refrigerator, so that the food may be stored in the refrigerating compartment or in the freezing compartment after being classified in accordance with storing temperature of the food.

Recently, there is suggested a refrigerator with an independent cooling system, which independently cools the refrigerating compartment and the freezing compartment with evaporators disposed at the refrigerating compartment and the freezing compartment, respectively.

In such a conventional refrigerator, being respectively disposed at the refrigerating compartment and the freezing compartment, two evaporators are communicated with each other through an assistant capillary pipe welded between refrigerant pipes respectively extending from the evaporators. Further, in order to prevent inner walls of the refrigerating compartment and the freezing compartment from being damaged by sparks generated during the welding operation for connecting the refrigerant pipes, the welding is carried out in the machinery chamber by guiding the refrigerant pipes into the machinery chamber defined at an upper portion of the refrigerator.

The machinery chamber is provided with a capillary pipe container provided with an assistant capillary pipe and with a thermal insulation member for thermally insulating the assistant capillary pipe, in order to prevent the assistant capillary pipe disposed in the machinery chamber from being affected by heat generated in the machinery chamber or to prevent condensed water from being generated in the machinery chamber due to cold air produced during expansion of the refrigerant caused by reduced pressure thereof in the assistant capillary pipe.

Meanwhile, when mounting the assistant capillary pipe and the thermal insulation member in the capillary pipe container, respectively, if force is applied to the assistant capillary pipe and the refrigerant pipe connected with each other, connection between the assistant capillary pipe and the refrigerant pipe, which are welded to each other, is weakened, so that the refrigerant may leak through the improper connection. Thus, a process for inspecting leakage of the refrigerant with a refrigerant detection device for detecting the leakage is included in the manufacturing process, in order to inspect for leakage of the refrigerant through the connection between the assistant capillary pipe and the refrigerant pipe after mounting the assistant capillary pipe in the capillary container.

However, in order to inspect for the leakage of the refrigerant through the connection between the assistant capillary pipe and the refrigerant pipe, the capillary pipe container should be disassembled before the leakage inspection, and then the capillary pipe container should be assembled again after the inspection. Thus, there occurs a problem that the operation for inspecting for the leakage of the refrigerant from the connection is complicatedly carried out.

SUMMARY OF THE INVENTION

Therefore, an aspect of the invention is to provide a refrigerator, which allows more easy inspection to detect leakage of refrigerant through connection between an assistant capillary pipe and a refrigerant pipe provided in a capillary pipe container.

In accordance with one aspect, the present invention provides a refrigerator, comprising: a body defined with a refrigerating compartment and a freezing compartment therein; a machinery chamber defined at an upper portion of the body and adapted to receive components of a refrigerant cycle therein; first and second evaporators for cooling the refrigerating and freezing compartments, respectively; a first refrigerant pipe extending from the first evaporator; a second refrigerant pipe extending from the second evaporator; an assistant capillary pipe connected between the first and second refrigerant pipes for cooling the refrigerating and freezing compartments to different temperatures; a capillary pipe container provided in the machinery chamber for receiving the assistant capillary pipe therein; and an inspection hole provided at one side of the capillary pipe container for allowing a refrigerant detection device for detecting leakage of refrigerant to be inserted into the capillary pipe container.

The capillary pipe container may comprise: a case provided with a containing portion opened at an upper side thereof such that the assistant capillary pipe may be received therein; and a cover adapted to close the containing portion and provided with the inspection hole.

The capillary pipe container may be provided with a thermal insulation member filling a space between the cover and the case for thermally insulating the assistant capillary, and the thermal insulation member may be provided with a guide hole elongated downward such that the refrigerant detection device after passing through the inspection hole accesses a lower side of the capillary pipe container.

The case may comprise a first communication pipe for communicating the machinery chamber with the freezing compartment such that the first refrigerant pipe may be allowed to be provided through a wall defining a lower surface of the machinery chamber, and a second communication pipe for communicating the machinery chamber with the refrigerating compartment such that the second refrigerant pipe may be provided through a lower surface of the machinery chamber.

BRIEF DESCRIPTION OF THE DRAWINGS

The above aspects, other features and advantages of the present invention will become more apparent after reading the following detailed description when taken in conjunction with the drawings, in which.

DETAILED DESCRIPTION OF THE PREFERRED EMBODIMENTS

An illustrative, non-limiting embodiment of the present invention will now be described in detail with reference to the accompanying drawings.

Figure 1:
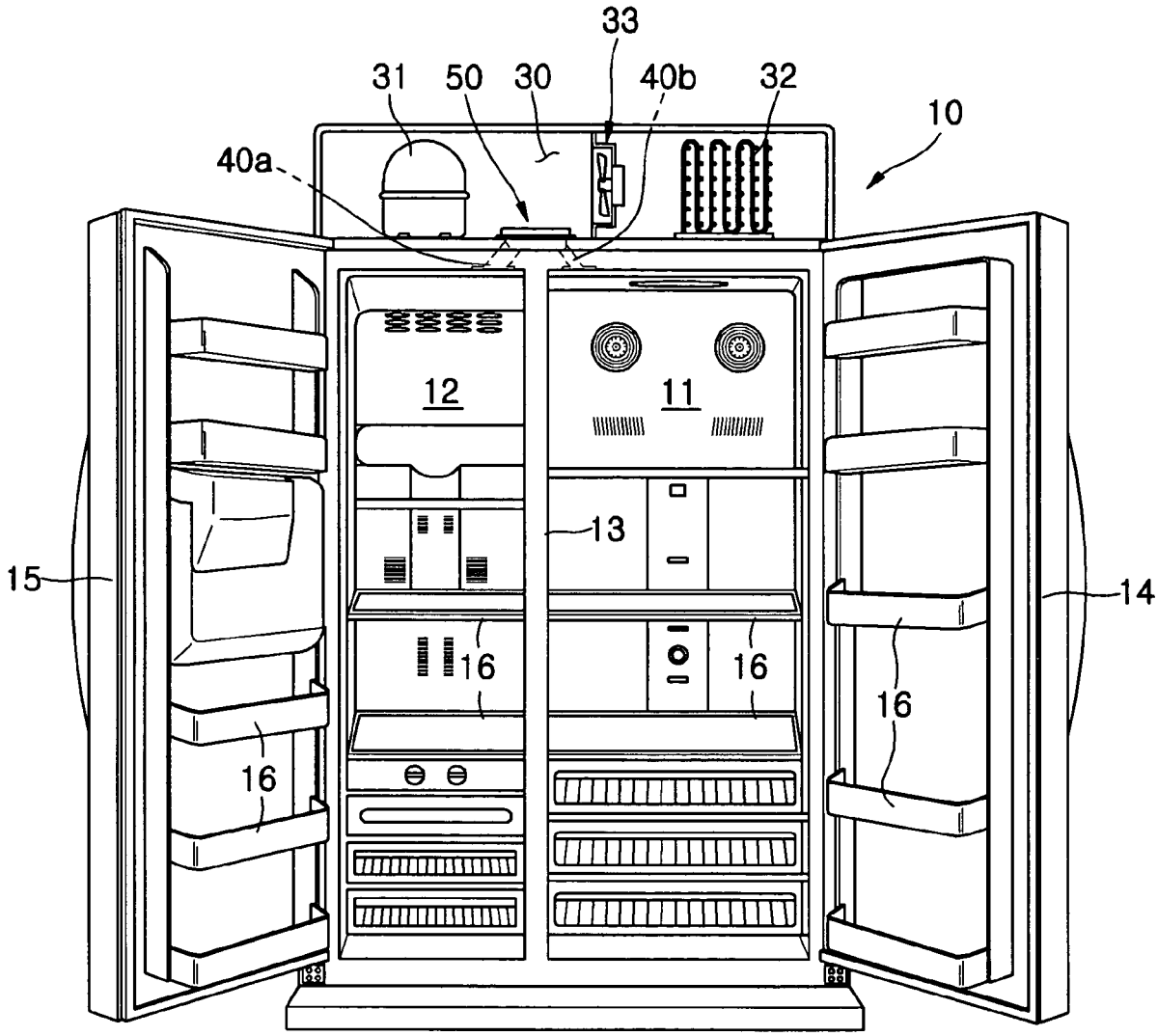
FIG. 1 is a front view illustrating a schematic configuration of a refrigerator according to the present invention.
Figure 2:
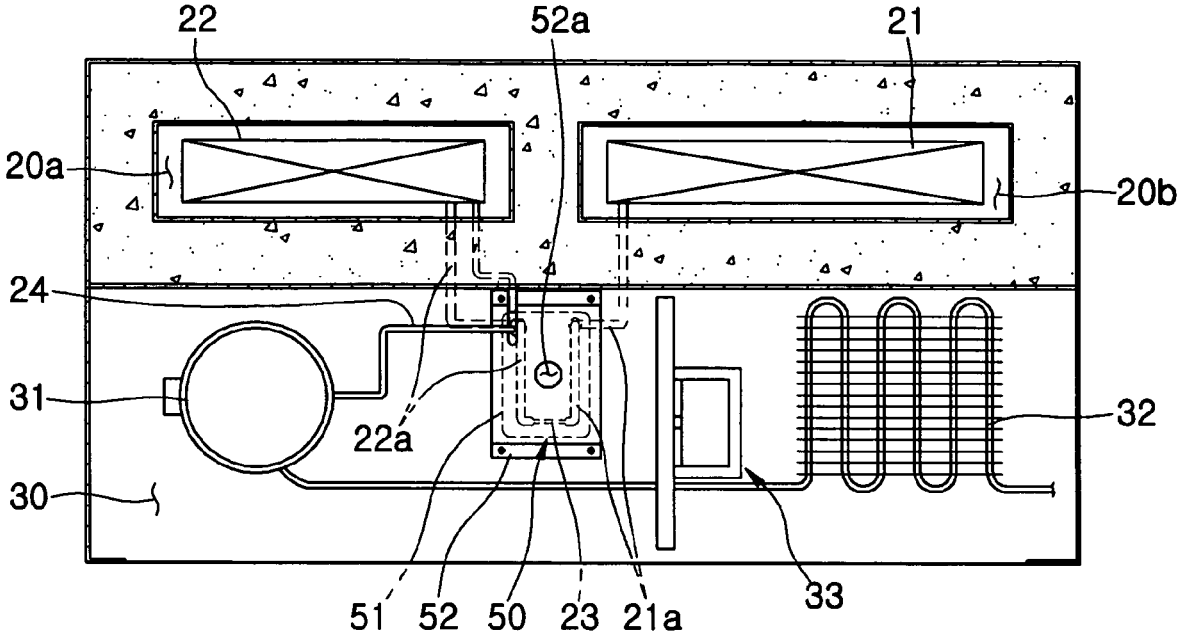
FIG. 2 is a cross sectional view showing the refrigerator according to the present invention.

As shown in FIGS. 1 and 2, a refrigerator according to the present invention is structured such that a body 10 defining an appearance of the refrigerator is partitioned to a pair of storage chambers opened at the front of the refrigerator for storing food therein, with an intermediate wall 13 interposed between the storage chambers, so that one of the chambers defines a refrigerating compartment 11 for storing the food in a refrigerated state and the other defines a freezing compartment 12 for storing the food in a frozen state.

The refrigerating and freezing compartments 11 and 12 are provided with a refrigerating compartment door 14 and a freezing compartment door 15, respectively. The refrigerating compartment 11, the freezing compartment 12, the refrigerating compartment door 14 and the freezing compartment door 15 are provided with a plurality of shelves for receiving the food therein, respectively.

The body 10 is provided at an upper portion thereof with components of a refrigerant cycle, which includes a compressor 31 for compressing refrigerant, a condenser 32 for cooling the refrigerant in a compressed state of a high pressure and a high temperature, a capillary pipe (not shown) for reducing the pressure of the refrigerant, thereby expanding the refrigerant, and evaporators 21 and 22 for generating cold air by expanding refrigerant.

The refrigerator according to the present invention employs an independent cooling system for independently cooling the refrigerating compartment 11 and the freezing compartment 12. For such an independent cooling system, first and second evaporators 21 and 22 are provided to cool the refrigerating and freezing compartments 11 and 12, respectively.

For mounting the components of the refrigerant cycle, the body 10 is defined with first and second cooling compartments 20*a* and 20*b* communicating with the refrigerating and freezing compartments 11 and 12, respectively, at the rear side of the upper portion of the body 10. The first and second cooling compartments 20*a* and 20*b* are provided with the first and second evaporators 21 and 22, respectively. The body 10 is also defined with a machinery chamber 30, at the front side of the upper portion thereof, which is provided with the compressor 31, the condenser 32 and a blowing fan 33 for cooling them.

The first and second evaporators 21 and 22 are respectively provided with refrigerant pipes for connecting the evaporators 21 and 22 with each other. Specifically, the first evaporator 21 is provided with a first refrigerant pipe 21*a*, such that the first refrigerant pipe 21*a* extending from the first evaporator 21 is connected to the second evaporator 22 in order to guide the refrigerant to the second evaporator 22. The second evaporator 22 is provided with a second refrigerant pipe 22*a*, such that the second refrigerant pipe 22*a* extending from the second evaporator 22 is connected to the first evaporator 21 to be supplied with the refrigerant from the first evaporator 21. An assistant capillary pipe 23 is provided between the first and second refrigerant pipes 21*a* and 22*a* such that the refrigerant passing through the first evaporator 21 is expanded again due to the reduced pressure thereof and then flows into the second evaporator 22, so that the first and second evaporators 21 and 22 have different cooling temperatures, respectively.

The first refrigerant pipe 21*a*, the second refrigerant pipe 22*a* and the assistant capillary pipe 23 are connected with each other by welding. In order to carry out the welding in the machinery chamber 30, the first refrigerant pipe 21*a* is guided into the machinery chamber 30 through a wall defining an upper surface of the refrigerating compartment 11 via the refrigerating compartment 11, and the second refrigerant pipe 22*a* is guided into the machinery chamber 30 through a wall defining an upper surface of the freezing compartment 12 via the freezing compartment 12.

For the above purpose, a first communication pipe 40*a* for communicating the refrigerating compartment 11 with the machinery chamber 30 and a second communication pipe 40*b* for communicating the freezing compartment 12 with the machinery chamber 30 are embedded in the walls defining the upper sides of the refrigerating and freezing compartments 11 and 12, respectively, such that the first and second refrigerant pipes 21*a* and 22*a* may be provided through the walls, respectively. Thus, the first refrigerant pipe 21*a* extending from the first evaporator 21 is guided into the machinery chamber 30 through the refrigerating compartment 11 and the first communication pipe 40*a*, and the second refrigerant pipe 22*a* extending from the second evaporator 22 is guided into the machinery chamber 30 through the freezing compartment 12 and the second communication pipe 40*b*, so that the welding operation for connecting the first refrigerant pipe 21*a*, the second refrigerant pipe 22*a* and the assistant capillary pipe 23 may be carried out in the machinery chamber 30.

At this time, the machinery chamber 30 provided with the assistant capillary pipe 23 is maintained at a higher temperature than the assistant capillary pipe 23 by heat generated from the compressor 31 and the evaporators 12 and 22, so that the assistant capillary pipe 23 tends to be affected by the heat in the machinery chamber 30, thereby reducing efficiency of the refrigerant cycle.

The machinery chamber 30 is defined with a capillary pipe container 50 for receiving the assistant capillary pipe 23, such that the assistant capillary pipe 23 is not affected by the heat in the machinery chamber 30 and such that condensed water is prevented from being produced in the machinery chamber 30 by cold air from the assistant capillary pipe 23.

Figure 3:
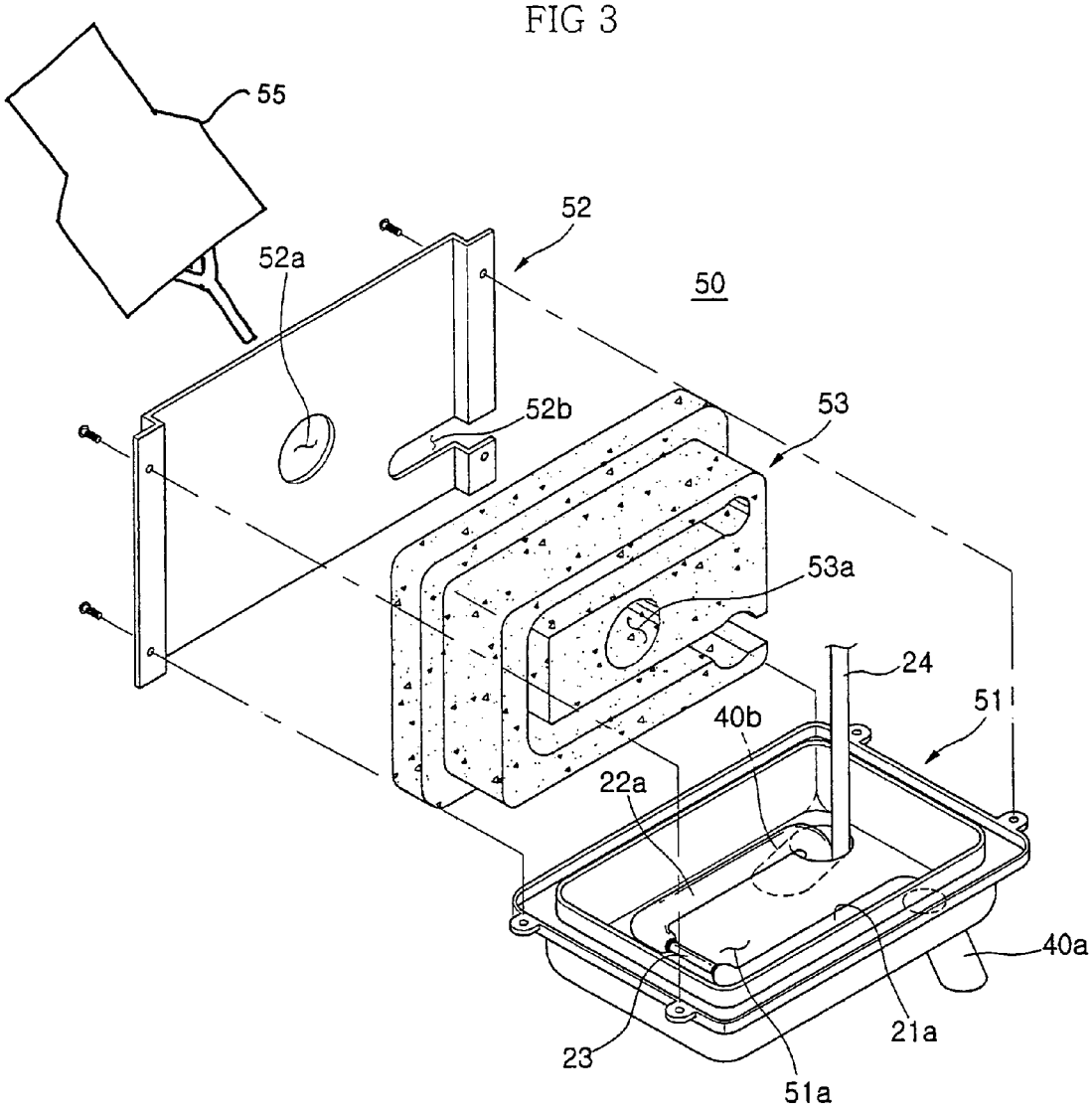
FIG. 3 is an exploded perspective view of a capillary pipe container of the refrigerator according to the present invention.

As shown in FIG. 3, the capillary pipe container 50 includes: a case 51 defined with a containing portion 51*a* opened at an upper side thereof and provided with the first and second communication pipes 40*a* and 40*b* integrally extending at a lower surface thereof; a cover 52 adapted to close the containing portion 51*a* of the case 52; and a thermal insulation member 53 filling a space between the case 51 and the cover 52 for thermally insulating the assistant capillary pipe 23. A portion of the thermal insulation member 53 is embedded, at a lower side of the thermal insulation member, in a wall constituting the lower surface of the machinery chamber 30.

The capillary pipe container 50 of the present invention is provided with an inspection hole 52*a* at one side thereof for enabling an inspection for leakage of the refrigerant through the connection between the assistant capillary pipe 23 and the refrigerant pipes 21*a* and 22*a* disposed in the capillary pipe container 40 without disassembling the capillary pipe container 50. The inspection hole 52*a* is structured such that a detection device 55 for detecting the leakage of the refrigerant may be inserted through the inspection hole. In the present invention, the inspection hole 52*a* is provided at the cover 52, so that the detection device 55 may be inserted to the capillary pipe container 50 through the cover 52.

The thermal insulation member 53 to be disposed in the containing portion 51*a* of the capillary pipe container 50 is provided with a guide hole 53*a* vertically extending at a position corresponding to the inspection hole 52*a*. Thus, the detection device 55 passing through the inspection hole 52*a* may be guided to access a lower side of the capillary pipe container, so that the detection device 55 accesses to the connection between the assistant capillary pipe 23 and the refrigerant pipes 21*a* and 22*a*, thereby enabling a more reliable detection of the leakage of the refrigerant.

Reference numeral "24" denotes a suction pipe extending from the second evaporator 22 through a penetration groove 52*b* provided at the second communication pipe 40*b* and the cover 52, thereby being provided at the compressor 31. The suction pipe 24 guides the refrigerant from the second evaporator 22 to the compressor 31.

A method of manufacturing the refrigerator according to the present invention and advantageous effects of the refrigerator will now be described.

First, after the first and second evaporators 21 and 22 are provided for the first and second cooling compartments 20*a* and 20*b* through the refrigerating and freezing compartments 11 and 12, respectively, the first refrigerant pipe 21*a* extending from the first evaporator 21 is guided into the machinery chamber 30 through the first communication pipe 40*a*, and the second refrigerant pipe 22*a* extending from the second evaporator 22 is guided into the machinery chamber 30 through the second communication pipe 40*b*. Then, the assistant capillary pipe 23 is welded between the first and second refrigerant pipes 21*a* and 22*a* which are guided into the machinery chamber 30, such that the first and second evaporators 21 and 22 are communicated with each other through the first and second refrigerant pipes 21*a* and 22*a*, so that the refrigerant may be transferred from the first evaporator 21 to the second evaporator 22.

Subsequently, after the assistant capillary pipe 23 provided between the first and second refrigerant pipes 21*a* and 22*a* is received in the containing portion 51*a* of the capillary pipe container 50, the containing portion 51*a* is fitted with the thermal insulation member 53, and the opened upper portion of the containing portion 51*a* is closed by the cover 52, thereby preventing the heat in the machinery chamber 30 from being transferred to the assistant capillary pipe 23.

After the containing portion 51*a* is closed by the cover 52, the detection device 55 is inserted into the capillary pipe container 50 through the inspection hole 52*a* and the guide hole 53*a* to detect the leakage of the refrigerant through the connection of the assistant capillary pipe 23 and the refrigerant pipes 21*a* and 22*a*.

As apparent from the description, in accordance with present invention, there are provided advantageous effects that the refrigerant includes the capillary pipe container provided with the inspection hole, through which the refrigerant detection device may be inserted into the capillary pipe container, so that the leakage of the refrigerant through the connection of the assistant capillary pipe and the refrigerant pipes in capillary pipe container can be easily inspected.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator, comprising:

a body defined with a refrigerating compartment and a freezing compartment therein;

a machinery chamber defined at an upper portion of the body and adapted to receive components of a refrigerant cycle therein;

first and second evaporators for cooling the refrigerating and freezing compartments, respectively; a first refrigerant pipe extending from the first evaporator;

a second refrigerant pipe extending from the second evaporator;

an assistant capillary pipe connected between the first and second refrigerant pipes for cooling the refrigerating and freezing compartments to different temperatures;

a capillary pipe container provided in the machinery chamber for receiving the assistant capillary pipe therein; and an inspection hole provided at one side of the capillary pipe container for allowing a detection device for detecting leakage of refrigerant to be inserted into the capillary pipe container.

2. The refrigerator according to claim 1, wherein the capillary pipe container comprises:

a case provided with a containing portion opened at an upper side thereof such that the assistant capillary pipe may be received therein; and a cover adapted to close the containing portion and provided with the inspection hole.

3. The refrigerator according to claim 2, wherein the capillary pipe container is provided with a thermal insulation member filling a space between the cover and the case for thermally insulating the assistant capillary, and the thermal insulation member is provided with a guide hole elongated downward such that the refrigerant detection device after passing through the inspection hole accesses a lower side of the capillary pipe container.

4. The refrigerator according to claim 2, wherein the case comprises a first communication pipe for communicating the machinery chamber with the freezing compartment such that the first refrigerant pipe may be allowed to be provided through a wall defining a lower surface of the machinery chamber, and a second communication pipe for communicating the machinery chamber with the refrigerating compartment such that the second refrigerant pipe may be provided through the lower surface of the machinery chamber.

* * * * *

UNITED STATES PATENT AND TRADEMARK OFFICE

CERTIFICATE OF CORRECTION

PATENT NO. : 7,024,881 B2
APPLICATION NO. : 10/814805
DATED : April 11, 2006
INVENTOR(S) : Sang Gyu Jung It is certified that error appears in the above-identified patent and that said Letters Patent is hereby corrected as shown below:

On the cover page, item (75), column 1, line 1, change “Gwangiu” to --Gwangju--

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,024,881 B2
APPLICATION NO. : 10/814805
DATED : April 11, 2006
INVENTOR(S) : Sang Gyu Jung It is certified that error appears in the above-identified patent and that said Letters Patent is hereby corrected as shown below:

On the cover page, item (75), column 1, line 1, change "Gwangiu" to --Gwangju--

This certificate supersedes Certificate of Correction issued November 21, 2006.

Signed and Sealed this

Second Day of January, 2007

JON W. DUDAS
*Director of the United States Patent and Trademark Office*